US005360453A

United States Patent [19]

Lauton et al.

[11] Patent Number: 5,360,453

[45] Date of Patent: Nov. 1, 1994

[54] PROCESS FOR PICKLING AND PRETANNING RAW HIDES

[75] Inventors: Alain Lauton, Saint-Louis, France; Markus Hess, Steinen-Hofen; Günter Streicher, Weil am Rhein, both of Germany; Alois Püntener, Rheinfelden, Switzerland

[73] Assignee: Ciba-Geigy Corporation, Ardsley, N.Y.

[21] Appl. No.: 7,421

[22] Filed: Jan. 22, 1993

[30] Foreign Application Priority Data

Jan. 28, 1992 [CH] Switzerland ..... 239/92-1

[51] Int. Cl.[5] ..... C14C 3/16; C14C 1/08

[52] U.S. Cl. ..... 8/94.33; 8/94.18; 252/8.57

[58] Field of Search ..... 8/94.18, 94.15, 94.33, 8/94.31, 94.32; 252/8.57

[56] References Cited

U.S. PATENT DOCUMENTS

| | | | |
|---|---|---|---|
| 20,502 | 6/1858 | Morgan | 8/94.33 |
| 30,393 | 10/1860 | Dietz | 8/94.33 |
| 2,941,859 | 6/1960 | Fein et al. | 8/94.33 |
| 2,941,859 | 6/1960 | Fein et al. | 8/94.33 |
| 3,909,193 | 9/1975 | Erdmann et al. | 8/94.33 |
| 4,830,632 | 5/1989 | Lauton | 8/94.33 |
| 4,936,864 | 6/1990 | Fikentscher et al. | 8/94.29 |
| 5,011,499 | 4/1991 | Rathfelder et al. | 8/94.33 |
| 5,011,499 | 4/1991 | Rathfelder et al. | 8/94.33 |

FOREIGN PATENT DOCUMENTS

| | | |
|---|---|---|
| 281486 | 9/1988 | European Pat. Off. . |
| 0310846 | 4/1989 | European Pat. Off. . |
| 18041 | 1/1914 | France . |
| 85933 | 11/1894 | Germany . |
| 190702 | 12/1904 | Germany . |
| 3308087 | 9/1984 | Germany . |
| 148126 | 7/1920 | United Kingdom . |
| 148898 | 3/1922 | United Kingdom . |
| 683084 | 11/1952 | United Kingdom . |
| WO92/13105 | 8/1992 | WIPO . |

OTHER PUBLICATIONS

The New Encyclopedia Britannica, 15th Edition, vol. 6, p. 35, (1986).

Abstract for DE 3308087, Sep. 1984.

Derwent Abstract for JP 57-100,200A, Jun. 22, 1982.

K. Lessen: Leder-Häutemarkt, 36, 14, 39-42 (1984) (month unknown).

*Primary Examiner*—Prince Willis, Jr.

*Assistant Examiner*—Alan D. Diamond

*Attorney, Agent, or Firm*—Kevin T. Mansfield

[57] ABSTRACT

A process for pickling and pretanning raw hides which comprises (I), pickling a raw hide in an aqueous liquor A which is devoid of salts and contains (a) a reaction product of phenol and a sulfonating agent, the molar ratio of (phenol):($SO_3$) being (1):(1.1-2.2), and (II), pretanning the pickled raw hide in the same bath by addition of an aqueous formulation B comprising (b) a reductive saccharide having a dextrose equivalent of 10 to 100, and (c) an aliphatic dialdehyde containing 2 to 8 carbon atoms. The combined one-bath pickling/pretanning process makes it possible to prepare, in treatment baths free from neutral salts and heavy metals, readily shaveable wet white leathers that are suitable for further processing by all conventional tanning methods.

20 Claims, No Drawings

PROCESS FOR PICKLING AND PRETANNING RAW HIDES

The present invention relates to a process for pickling and pretanning raw hides as well as to the leather material obtained by said process.

To make a hide ready for tanning, a delimed and bated raw hide must first be subjected to a pickling treatment. The object of this treatment is to adjust the raw hide to a pH in the range from 3–4 at which the conventional tanning agents act best. For pickling it is common practice to use sulfuric, hydrochloric or formic acid with the requisite simultaneous addition of a neutral salt, typically sodium chloride or sodium sulfate. The neutral salt prevents a deleterious plumping of the collagen ("acid plumping") induced by the acid.

The pretanning step which follows on the pickling process is normally carried out in liquors that contain heavy metals, typically in highly basic aluminium or zirconium baths, and preferably in chromium salt baths.

The wastewaters of these treatment baths that contain neutral salts and heavy metals are very problematical from the ecological aspect and constitute a substantial pollution factor. For this reason efforts are being made to provide treatment baths that are devoid of these compounds or which at least contain them in only minor concentrations.

A combined pickling and pretanning process has now been found that, surprisingly, makes it possible to carry out pickling and tanning in a one-bath process in which mineral and neutral salts can be dispensed with and by means of which good pickling and tanning results are obtained.

Accordingly, the invention provides a process for pickling and pretanning raw hides, which comprises (I) pickling the raw hide in an aqueous liquor A which is devoid of salts and contains
  (a) a reaction product of phenol and a sulfonating agent, the molar ratio of (phenol):($SO_3$) being (1):(1.1–2.2), and (II) pretanning the pickled raw hide in the same bath by addition of an aqueous formulation B consisting of
  (b) a reductive saccharide having a dextrose equivalent of 10 to 100, and
  (c) an aliphatic dialdehyde containing 2 to 8 carbon atoms.

The preferred sulfonating agent for obtaining component (a) is $SO_3$ or, most preferably, oleum. Oleum is a solution of $SO_3$ in concentrated sulfuric acid. Hence particularly suitable reaction products are those of phenol and oleum, most preferably those in which the molar ratio of (phenol):($SO_3$) is (1):(1.4–1.8).

The reaction product of phenol and oleum is known per se. Thus GB-A-0 683 084 discloses the preparation of reaction products of phenol and oleum which, however, are further reacted with e.g. formaldehyde and urea or thiourea and are used as tanning agents. The reaction product of the present invention is a mixture the main component of which consists of sulfonated dihydroxydiphenyl sulfones.

The pickling liquor A contains component (a) in a concentration of 1 to 10 % by weight, preferably of 3 to 5 % by weight, based on the weight of the raw hide.

In addition to component (a), a $C_1$–$C_3$ carboxylic acid as optional component (a1) is added to the pickling liquor in an amount of 0 to 1% by weight, preferably of 0.1 to 1% by weight. Typical examples of such carboxylic acids are formic acid, acetic acid or propionic acid. It is preferred to use formic acid for the pickling step.

Saccharities useful as component (b) are the customary aldoses and ketoses having a dextrose equivalent of 10 to 100. These compounds are preferably mono- and disaccharides, and also oligosaccharides and polysaccharides.

By dextrose equivalent is meant the amount, calculated in grams, of saccharide that corresponds to 100 grams of dextrose with respect to the reductive capacity.

In the process of the present invention it is preferred to use mono- or disaccharides. Suitable monosaccharides are typically glucose, fructose, mannose, arabinose and ribose. Typical representatives of the disaccharides are saccharose, maltose or lactose. It is preferred to use monosaccharides in the process of the invention. Preferred monosaccharides are aldoses, glucose being especially preferred on account of the case with which it can be obtained and of its availability in technical amounts. Glucose syrups having a dextrose equivalent of 20 to 90, preferably of 40 to 80, are particularly suitable on account of their reasonable price.

Dialdehydes useful as component (c) are quite generally all dialdehydes or mixtures thereof that contain 2 to 8 carbon atoms and have structurally saturated aliphatic C—C bonds. Illustrative examples of such dialdehydes arc glyoxal, malonaldehyde, succinaldehyde, glutaraldehyde, adipaldehyde, pimclaidchyde as well as the dialdehyde derived from suberic acid. Preferred representatives am succinaldehyde, glutaraldehyde, adipaldehyde and glyoxal, among which glutaraldehyde is especially preferred. The dialdehydes are normally available as commercial dialdehydes which contain 25 to 50 % by weight of water.

The aqueous formulation B is conveniently prepared by dissolving component (a) at a temperature in the range from 20 to 60° C. and subsequently adding component (b) to the resultant clear solution.

The aqueous formulation so obtained is liquid and has good shelf stability.

Preferably the formulation B comprises (b) a reductive saccharide having a dextrose equivalent of 10 to 100, and
(c) glutaraidehyde.

In an especially preferred embodiment, formulation B comprises (b) a monosaccharides having a dextrose equivalent of 100, and
(c) glutaraldehyde.

In another preferred embodiment, formulation B comprises (b) a disaccharides having a dextrose equivalent of 20 to 60, and
(c) glutaraldehyde.

Formulations B meriting particular interest are those comprising 2 to 60 % by weight, preferably 10 to 40 % by weight, of component (b), 2 to 75 % by weight, preferably 30 to 55 % by weight, of component (c), and water to make up 100 %. Those aqueous formulations B are also preferred which contain, per mol of component (c), 0.05 to 0.19 mol of component (b).

In a preferred embodiment of the inventive process, liquor A comprises 1 to 10% by weight of component (a), and
0 to 5% by weight of component (a1) and, after pickling, the pickled raw hide is pretanned with an aqueous formulation B comprising 2 to 60% by weight of component (b), and
2 to 75% by weight of component (c).

In a particularly preferred embodiment of the inventive process, liquor A comprises (a) 1 to 10% by weight of the reaction product of phenol and a sulfonating agent, the molar ratio of (phenol):($SO_3$) being (1):(1.4–1.8), and (a1) 0 to 5% by weight of formic acid, and formulation B comprises (b) 2 to 60% by weight of a monosaccharides having a dextrose equivalent of 100, and (c) 2 to 75% by weight of glutaraldehyde.

The combined pickling and pretanning process of this invention is carried out for example by washing delimed raw hide with water at room temperature, preferably in the temperature range from 20 to 30° C., for 10 to 20 minutes, and thereafter treating the washed hides for 90 to 180 minutes in an aqueous pickling liquor which contains component (a). The pH of the pickling liquor is in the range from 3 to 4. The pickling treatment is carried out at room temperature, preferably from 20 to 30° C., most preferably from 20 to 25° C. If in a preferred embodiment of the inventive process the pickling liquor additionally comprises the optional component (a1), then the procedure is such that the hide is treated for 15 minutes in the aqueous liquor A that contains half of the above indicated concentration of component (a). After this step, the second half of component (a) is added to the pickling liquor as well as component (a1) and further treatment is carried out in conventional manner. For the subsequent pretanning step, the aqueous formulation B is added to the pickling liquor. The pH is adjusted to 3.5–4.5, and further treatment is carried out for 8 to 14 hours in the temperature range from 20 to 30° C.

It is not necessary to add further ingredients to the treatment bath for carrying out the inventive process.

The entire treatment is carried out in a winch beck or, preferably, in a rotating drum.

The treated leather can be very readily hydroextracted, so that it is also easier to shave the leather to the desired thickness. This pretanned leather is eminently suitable for further processing with all conventional mineral, vegetable and synthetic tanning agents. The pretanned leather is most especially suitable for making wet white leathers. It has a soft, full handle.

Finished tanned leathers can also be obtained by carrying out the inventive process in analogous manner.

Suitable raw hides are all animal hides that can be processed to leather.

In the following Working and Application Examples, pans and percentages are by weight.

EXAMPLE 1

Preparation of component (a)

136.5 parts of phenol (1.45 mol) are fused at 45° C. To this melt are slowly added 193.4 parts of 20 % oleum (2.08 mol $SO_3$) such that the temperature of the reaction mixture does not rise above 160° C. The reaction mixture is then kept, with stirring, under reduced pressure at 20 torr/160° C. for 6 hours, during which time the water of reaction is removed from the reaction mixture as an azeotrope together with minor amounts of phenol. The reaction mixture is then cooled under normal pressure to 40° C., giving 253 parts of a fused mixture the main component of which consists of sulfonic acids of formula (101)

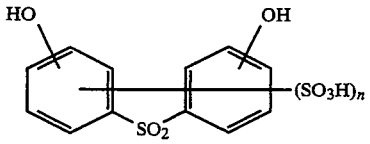

(n = 1 or 2).

Phenolsulfonic acid is additionally formed as by-product.

EXAMPLE 2

Preparation of formulation B

A sulfonating flask is charged with 167 ml of water and heated to 60° C. With good stirring, 167g of glucose monohydrate (dextrose equivalent 100) are added over 20 minutes. When all has dissolved, 666 g of 50 % glutaraldehyde are run in. The resultant clear, pale solution has a pH of 3.9–4.2. The solids content is 50%.

APPLICATION EXAMPLES

EXAMPLE 3

A delimed raw hide is washed with 200% of water for 15 minutes at 25° C. This hide is put into a pickling liquor comprising, based on the weight of the hide, 50 % of water and 2 % of the reaction product obtained according to Example 1.

The hide is treated for 30 minutes at 25° C. The pH of the treatment liquor is c. 3.0. To this liquor are then added 2% of the reaction product obtained according to Example 1 and 0.4% of 85% formic acid. The pH of the liquor is then 3.3–3.5. Treatment is carried out at the same temperature for 150 minutes.

Afterwards 1.5 % of the formulation of Example 2 is added to the pickling liquor. The pH of the liquor is adjusted to 4.0 with pulverised sodium hydrogen carbonate or sodium hydrogen sulfate. Further treatment is carried out for 8 to 16 hours at a temperature of 25° C.

The white leather so obtained is hydroextracted and shaved to the desired thickness. This pretanned leather is admirably suitable for further processing with mineral, vegetable or synthetic tanning agents to give leathers free from heavy metals.

EXAMPLE 4

The procedure of Example 3 is repeated, but replacing 1.5% of the formulation of Example 2 with 1% of glutaraldehyde and 0.6% of a 50% glucose syrup having a dextrose equivalent of 60, to give a wet white leather with a shrinkage temperature of c. 75° C.

What is claimed is:

1. A process for pickling and pretanning raw hides, which comprises (I) pickling the raw hide in an aqueous liquor A which is devoid of salts and contains (a) a reaction product of phenol and a sulfonating agent, the molar ratio of (phenol):($SO_3$) being (1):(1.1–2.2), and (II) pretanning the pickled raw hide in the same bath by addition of an aqueous formulation B comprising (b) a reductive saccharide having a dextrose equivalent of 10 to 100, and (c) an aliphatic dialdehyde containing 2 to 8 carbon atoms.

2. A process according to claim 1, wherein the molar ratio of (phenol):($SO_3$) in the reaction product (a) is (1):(1.4–1.8).

3. A process according to claim 1, wherein the reaction product (a) is a mixture that contains sulfonated dihydroxydiphenyl sulfones as the main component.

4. A process according to claim 1, wherein the aqueous pickling liquor A contains the reaction product (a) in an amount of 1 to 10 % by weight, based on the weight of the hide.

5. A process according to claim 1, wherein the aqueous liquor a further comprises a $C_1$–$C_3$ carboxylic acid as optional component (a1).

6. A process according to claim 5, wherein the optional component (a1) is formic acid.

7. A process according to claim 6, wherein the liquor A contains component (a1) in a concentration of 0 to 1% by weight.

8. A process according to claim 1, wherein component (b) is a monosaccharides having a dextrose equivalent of 100 or a disaccharides having a dextrose equivalent of 20 to 60.

9. A process according to claim 8, wherein the monosaccharides is glucose.

10. A process according to claim 1, wherein component (c) is glutaraldehyde.

11. A process according to claim 1, wherein said formulation B comprises (b) a monosaccharides having a dextrose equivalent of 100, and (c) glutaraldehyde.

12. A process according to claim 1, wherein said formulation B comprises (b) a disaccharides having a dextrose equivalent of 20 to 60, and (c) glutaraldehyde.

13. A process according to claim 1, wherein said formulation B comprises 2 to 60% by weight, of component (b), 2 to 75% by weight, of component (c), and water to make up 100%.

14. A process according to claim 1, wherein said formulation B comprises 10 to 40% by weight of component (b), 30 to 55% by weight of component (c), and water to make up to 100%.

15. A process according to claim 1, wherein said formulation B contains, per mol of component (c), 0.05 to 0.19 tool of component (b).

16. A process according to claim 5, wherein said liquor A comprises 1 to 10% by weight of component (a), 0 to 5 % by weight of component (a1), and said formulation B comprises 2 to 60 % by weight of component (b), and 2 to 75 % by weight of component (c).

17. A process according to claim 16, wherein said liquor A comprises (a) 1 to 10% by weight of the reaction product of phenol and a sulfonating agent, the molar ratio of (phenol):($SO_3$) being (1):(1.4–1.8), and (a1) 0 to 5% by weight of formic acid, and said formulation B comprises (b) 2 to 60% by weight of a monosaccharides having a dextrose equivalent of 100, and (c) 2 to 75% by weight of glutaraldehyde.

18. A process according to claim 1, wherein the pickling treatment time is from 90 to 180 minutes.

19. A process according to claim 1, wherein the pickling step is carried out in the pH 20. A process according to claim 1, wherein the pickling treatment is carried out in the temperature range from 20 to 30° C.

* * * * *